United States Patent [19]

Gunther

[11] 4,276,991

[45] Jul. 7, 1981

[54] FLOATING ROOFS WITH MAGNETIC SEALS

[76] Inventor: Arnold Gunther, 29 Lorelei Rd., West Orange, N.J. 07052

[21] Appl. No.: 36,378

[22] Filed: May 4, 1979

[51] Int. Cl.[3] ..... B65D 88/44

[52] U.S. Cl. ..... 220/223; 220/222

[58] Field of Search ..... 220/223, 222

[56] References Cited

U.S. PATENT DOCUMENTS

| | | | |
|---|---|---|---|
| 2,650,738 | 9/1953 | Ulm | 220/223 |
| 3,033,413 | 5/1962 | Fino et al. | 220/223 |
| 3,204,808 | 9/1965 | Cadwell | 220/223 |
| 3,204,809 | 9/1965 | Cadwell | 220/222 |

*Primary Examiner*—Steven M. Pollard

[57] ABSTRACT

The closure of the rim space between the floating roof periphery and the tank shell is effected by a permanently magnetized circular strip and a circular curtain. The magnetized strip is held by magnetic pull against the shell.

Linkage means between the floating roof and the magnetized strip cause the latter to follow the vertical displacements of the former.

1 Claim, 3 Drawing Figures

FLOATING ROOFS WITH MAGNETIC SEALS

BACKGROUND OF THE INVENTION

The control of the evaporation loss emanating from the liquids stored in the tanks is effected, in the prior art, through the utilization of floating roofs.

These floating roofs consist essentially of a metallic pan that floats on the surface of the stored liquid.

Sealing means are provided to close the annular rim space between the periphery of the pan and the relatively concentrical tank shell. Two general types of seal are prominently used in the prior art.

For purposes of description these seals can be classed as metallic and non-metallic. The metallic class utilizes a light gage metal band as the sliding contact with the tank shell. This band is formed by sheets (called shoes) and may vary in dimension from the different manufacturers. The shoes are joined together to form a complete ring.

Generally, the band is of galvanized steel approximately 16 gage. Provision is made for expansion or contraction of the ring as it passes over shell irregularities, rivets and the like. This is accomplished by narrow pieces of fabric joined into the ring. The rim space between the roof and the shoe is sealed by bolting or clamping a coated-fabric from the shoe to the rim plate of the roof.

The non-metallic class utilizes a coated-fabric band as the sliding contact with the tank's shell. The forces needed to expand the seal against the tank shell are provided by a liquid, a gas under pressure, or a resilient foam.

The tank sizes to which the present invention is directed vary from about 20 feet up to about 250 or 300 feet in diameter.

Perfect fit between the seals and the tank shell is a practical impossibility for such a large structures, mainly due to out of roundness and local irregularities in the shell.

Evaporation of the stored liquid takes place through the gaps between the seal and the shell.

In practice this evaporative loss attains sizable proportions due to the substantial length of the sealed perimeter.

The present invention, by providing a tight fit over the whole perimeter, overcomes the shortcomings of the prior art.

SUMMARY OF THE INVENTION

The present invention deals with devices that substantially eliminate the evaporation loss emanating from the operation of liquid holding storage tanks and thus fulfills two objectives: air pollution abatement and product conservation.

A main objective is to provide evaporation loss control devices that overcome the shortcomings of the prior art and thus decreases the emissions from storage tanks into the atmosphere to negligible levels.

The storage tanks contemplated in the present invention operate at essentially atmospheric pressure. The size of these tanks vary from about 20 feet to 300 feet in diameter.

They are cylindrically shaped and may or may not have a fixed roof.

In the present invention the sealing of the annular rim space between the floating roof and the tank shell is effected by a magnetized circular strip and a flexible curtain joining the circular strip to the floating roof.

The even magnetic pull between the steel shell and the magnetized circular strip, holds the latter tightly adhered to the shell.

The magnetized circular strip, which is sufficiently flexible as to offer very small resistance to bending stresses, follows the curvature of the shell under the action of the magnetic pull, thus providing a uniform sealing pressure along its circumferential length.

The magnetization of the strip is permanent and its magnetic intensity is made of enough magnitude to assure a tight fit against the tank shell.

Therefore, the magnetic pull is sufficient to provide the bending stresses necessary to force the strip to follow very closely the shell curvature.

A flexible curtain which is sealed, by convenient means, to the magnetized strip and to the floating roof, completes the closure of the annular rim space between the tank shell and the floating roof.

The circular strip is connected by a convenient mechanical linkage to the floating roof which allows it to follow the vertical displacements of the latter. The magnetized circular strip is preferable split into a plurality of circular segments, and a relatively small gap is left between consecutive segments.

The sum of the lengths of all the circular segments is thus somehow smaller than the circumferential length of the shell.

The gaps will allow for changes in the shell diameter as the strips displace in the vertical direction, following the changes in the liquid level.

In order to avoid loss of vapor through the gaps, covers are provided over them. It will be clearly seen in the detailed description of the invention that the segmental strips are free to slide inside the gap covers, while keeping the vapors from escaping into the atmosphere.

BRIEF DESCRIPTION OF THE DRAWINGS

Reference is now made to the drawings.

DETAILED DESCRIPTION

Figure 1:
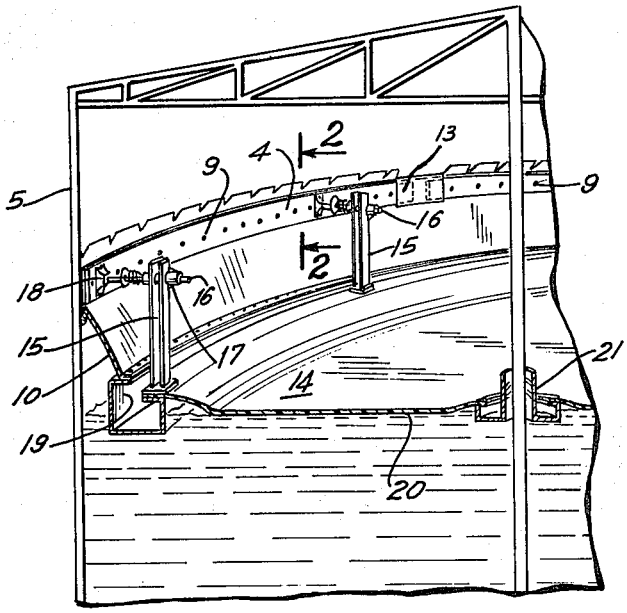
FIG. 1 is a perspective view of a typical embodiment, in which the floating roof consists of an annular floating trough and a circular blanket that is attached to the trough thus covering substantially the liquid surface, except for the peripheral annular rim between the tank shell and the trough. This rim is covered by a magnetized circular strip and a curtain.
Figure 2:
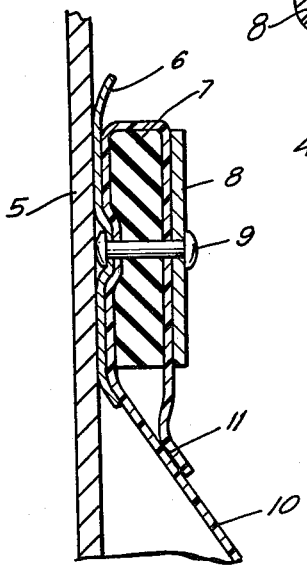
FIG. 2 is a cross-sectional view along 2—2, showing the assembly of a typical embodiment for the permanently magnetized circular strips.

The circular segments of the magnetic seal, which are indicated in FIG. 1 with the numeral 4, are located along the circumference of the tank's shell 5.

In the preferred embodiment of this invention, the circular segments are made of three parallel flexible strips, which are held together by convenient means, such as riveting.

A flexible strip 6, of non-magnetic material, such as brass or stainless steel is in sliding contact with the shell 5.

A flexible strip 7, of a permanently magnetized material, is sandwiched between the strips 6 and 8.

Strip 8 is a flexible strip of a strongly magnetic material such as steel, usually galvanized or otherwise coated for rust prevention. Rivets 9 hold together the above mentioned strips.

The curtain 10, made of a flexible material such as rubber coated fabric or from any other convenient material such as polyurethane, polyethylene, etc., is wrapped around the magnetic strip 7 to provide it with adequate protection from the action of the stored liquids and their vapors, as well as weatherability.

It is sealed, by cementing or welding, at 11.

The magnetic strip 7 is fabricated by extruding an elastomeric compound filled with a ferrite. The extruded strips is then subjected to a magnetic field that imparts to it a permanent magnetization.

Depending on the intensity of the applied magnetic field and on the thickness of the extrudate, magnetic strips having a magnetic pull from a few ounces to a few pounds per square inch of surface are attainable.

The magnetic pull is defined as the force necessary to pull apart a magnetized strip from an adjoining steel surface.

This pull can be decreased, if necessary, by leaving an air gap or by interposing non-magnetic materials between the steel and the magnetic strip surface.

By choosing the gap thickness and the magnetic intensity of the strip it is possible to regulate at will the sealing pressure obtainable. The magnetic intensity is defined as the magnetic moment per unit volume of the magnetized strip. The magnetic pull between the tank shell and a permanently magnetized flexible strip is increased by locating a steel strip (8) on the opposite face of the magnetic strip. It may now be realized that by controlling the gap width and the magnetic intensity one can obtain any intermediate seal pressure between substantially none up to the maximum one, the latter corresponding to a zero gap width.

Because of the relatively large diameter of the tank shells contemplated in this invention, the curvature of the shell is relatively small, and for relatively short strips the departure from a straight line is quite small.

Therefore the bending stresses required to accommodate a straight strip to the shell curvature are substantially small. A fraction of the available magnetic pull will develop the forces necessary for bending the strip from a straight line to the shell's curvature. The remaining of the magnetic pull will thus be available to provide the seal pressure.

The component metallic strips: 6 and 8, are relatively thin to impart them a great flexibility. Gages 16 to 22 are normally used. When thicker metallic strips are used, the segmental circular magnetic seals may be built with an initial curvature equal to the shell curvature. In this case the available magnetic pull will be fully utilized to impart the sealing pressure.

The tank diameter varies somewhat along the height of the tank and consequently the circumferential length for horizontal cross sections of the tank at various heights is not constant.

As the magnetic seal displaces vertically following the changes in the liquid level, the gap width between the successive circular segments 4 will vary.

Figure 3:
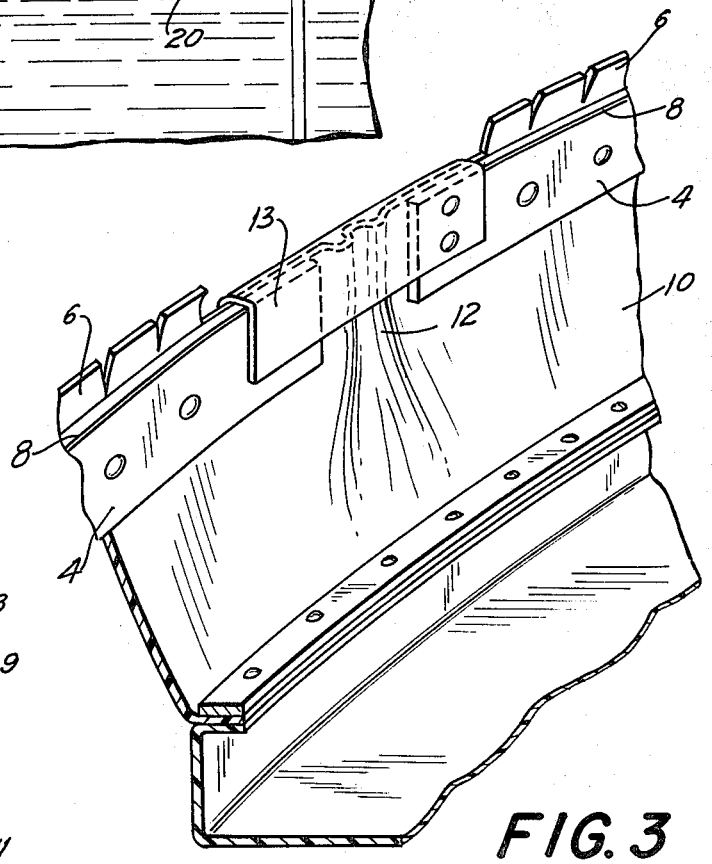
FIG. 3 is a perspective view showing a typical closure detail over the gaps between successive permanently magnetized circular segments.

The portions 12 of the continuous curtain 10 comprised between two successive circular segments, will adjust themselves to the change in the gaps width by folding or pleating, as shown schematically in FIG. 3.

In order to minimize the escaping of the vapors through the channels formed by the pleats in the curtain, covers 13 are provided over the gaps.

The covers 13 which have the shape of U channel, are usually made of the same material as the strips 6.

These covers fit snugly over the ends of the circular segments, with the curtain 12 abutting against the top portion of the cover, thus providing a seal against the escape of the vapors.

The cover is fixed by one of its ends to the extremity of one of the circular segments while is free to slide over the extremity of the opposite circular segment, thus assuring the gap closure at all times.

The vertical displacements of the floating roof 14 are followed by the magnetic seal through a mechanical linkage.

The linkage as depicted in FIG. 1 consists of a post 15 fixed to the floating roof, a spring loaded rod 16 that slides in a bushing 17 and engages into a recess of the element 18, the latter being fixed to the magnetic seal.

The variations in the tank diameter along its height are followed by the spring loaded rods 16 which will displace radially while keeping always engaged with the magnetic seal.

The floating roofs of the prior art, as described in the background of this invention, are essentially metallic pans, and they fall under three main categories: double deck, pontoons and pans.

All of them are built by welding, usually in situ, the component plates into the final desired shape. The sizable weight of the material involved and the installation labor are considerable.

A substantially less costlier floating roof is achieved by using lightweight polymeric materials as the main component of the floating roof.

A large variety of these polymeric materials, such as polyethylene, polypropylene, polyurethane, polyvinyls, fluoropolymers, etc., are readily available, and by proper choice of these materials, most of the industrially stored products can be handled.

A floating roof built in accordance with the above, as shown in FIG. 1 consists of a circular metallic floating trough 19 to which a plastic blanket 20, that floats on the surface of the stored liquid, is attached and sealed along its periphery.

The curtain 10 which is also attached and sealed to the floating trough and the magnetic seal, completes the closure of the stored liquid and its vapors.

For tanks having roof support columns, a column floating seal 21 is provided, essentially as shown in FIG. 1.

The strip 6, which is in sliding contact with the shell 5, is usually provided for protection of the portion of the curtain 10 that lies between strips 7 and 6.

Burrs, and other protuberances in the shell could cause damage to the curtain.

But, in certain cases, such as where the shell has been properly ground or coated, one can dispense from using the strip 6.

I claim:

1. A magnetic seal for a floating roof steel tank in which a generally cylindrical tank is provided with a cylindrical floating roof therewithin of a diameter less than the inside diameter of the tank, the magnetic seal comprising a plurality of substantially narrow, flexible and permanently magnetized segments, the width of said segments being a fraction of the height of the floating roof, the totality of the segments covering substantially the inner circumference of said tank's shell, a ring-like shaped, flexible curtain with its outer circumferential portion attached to said plurality of magnetized segments and its inner circumferential portion attached to said floating roof, said permanently magnetized segments being composed of: a substantially thin and narrow metallic strip in sliding contact with the tank's shell, said metallic strip being substantially non-magnetic, a narrow and permanently magnetized flexible strip parallelly located to said non-magnetic metallic strip, a narrow and substantially thin metallic strip facing said magnetized strip, the said non-magnetic metallic strip, magnetized strip, metallic strip and outer circumferential portion of said curtain being held together by convenient fastening means, linkage means between said floating roof and said plurality of segments, said linkage means causing the segments to follow the vertical displacements of the floating roof.

* * * * *